US010317139B2

(12) United States Patent
Jarmon

(10) Patent No.: US 10,317,139 B2
(45) Date of Patent: Jun. 11, 2019

(54) METHOD AND APPARATUS FOR PROCESSING PROCESS-ENVIRONMENT-SENSITIVE MATERIAL

(71) Applicant: United Technologies Corporation, Hartford, CT (US)

(72) Inventor: David C. Jarmon, Kensington, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 930 days.

(21) Appl. No.: 14/503,468

(22) Filed: Oct. 1, 2014

(65) Prior Publication Data

US 2015/0377552 A1 Dec. 31, 2015

Related U.S. Application Data

(60) Provisional application No. 61/888,540, filed on Oct. 9, 2013.

(51) Int. Cl.
*F27B 9/02* (2006.01)
*F27B 9/36* (2006.01)
(Continued)

(52) U.S. Cl.
CPC ..... *F27B 9/028* (2013.01); *F27B 9/045* (2013.01); *F27B 9/36* (2013.01); *F27B 9/40* (2013.01); *F27D 2019/0084* (2013.01)

(58) Field of Classification Search
CPC .. F27B 9/028; F27B 9/029; F27B 9/04; F27B 9/045; F27D 2019/0084; H01L 21/02035
(Continued)

(56) References Cited

U.S. PATENT DOCUMENTS 3,512,951 A * 5/1970 Long ..... C03B 11/005 65/252
3,647,266 A * 3/1972 Hurd ..... B65G 51/03 406/83

(Continued)

FOREIGN PATENT DOCUMENTS

JP 05102208 A * 4/1993 ..... H01L 24/75

*Primary Examiner* — Steven B McAllister
*Assistant Examiner* — Steven S Anderson, II
(74) *Attorney, Agent, or Firm* — Carlson, Gaskey & Olds, P.C.

(57) ABSTRACT

A disclosed method includes serially moving a plurality of dies through a series of interconnected chambers that are selectively sealable from each other. Through the series of interconnected chambers, each of the dies is introduced into a controlled gas environment, each of the dies is introduced into a controlled temperature environment, a process-environment-sensitive material is pressurized in each of the dies, and each of the dies is cooled. A disclosed apparatus includes a series of interconnected chambers that are selectively sealable from each other. A first one of the chambers is configured to establish a controlled gas environment therein, a second one of the chambers is configured to establish a controlled temperature environment therein, a third one of the chambers is configured to pressurize a process-environment-sensitive material and a fourth one of the chambers is configured to cool the process-environment-sensitive material.

18 Claims, 4 Drawing Sheets

(51) Int. Cl.
*F27B 9/40* (2006.01)
*F27B 9/04* (2006.01)
*F27D 19/00* (2006.01)

(58) Field of Classification Search
USPC ..... 264/328.11
See application file for complete search history.

(56) References Cited

U.S. PATENT DOCUMENTS 3,708,157 A * 1/1973 Aubry ..... F27B 9/045 432/126
3,773,391 A * 11/1973 Crandall ..... B65G 51/03 406/88
3,850,318 A * 11/1974 Wentworth ..... F27B 9/22 198/717
4,410,394 A * 10/1983 Stalcup ..... G02B 5/08 156/242
4,428,763 A * 1/1984 Layden ..... C03B 19/02 264/109
4,573,902 A * 3/1986 Heilman ..... B29C 33/202 264/236
6,415,630 B1 * 7/2002 Coriand ..... C03B 19/02 65/100
2004/0239019 A1 * 12/2004 Shimosato ..... C21D 1/773 266/252
2007/0245851 A1 * 10/2007 Sagawa ..... B22F 3/1021 75/10.67
2008/0282737 A1 * 11/2008 Ohgami ..... C03B 11/005 65/157
2010/0151129 A1 * 6/2010 Schmid ..... C23C 14/0623 427/255.23
2014/0157828 A1 * 6/2014 Dannoux ..... C03B 35/14 65/103

* cited by examiner

METHOD AND APPARATUS FOR PROCESSING PROCESS-ENVIRONMENT-SENSITIVE MATERIAL

CROSS-REFERENCE TO RELATED APPLICATION

This application claims priority to U.S. Provisional Application No. 61/888,540, filed Oct. 9, 2013.

BACKGROUND

Ceramic material, glass material and other high temperature-resistance materials can provide desirable properties for use in relatively severe operating environments, such as in gas turbine engines. Often, such materials are used in composites, such as fiber-reinforced ceramic or glass matrix composites. These composites can be fabricated using chemical vapor infiltration or polymer infiltration/pyrolysis, for example, which involve cyclic infiltration of a fiber structure with a material that forms the matrix. The composites must be formed to near full density to achieve the desired properties. However, known processing techniques require very long periods of time to achieve the desired density, which increases fabrication costs beyond practical limits and prevents the use of composites.

SUMMARY

A method for continuous thermal processing of process-environment-sensitive material according to an example of the present disclosure includes serially moving a plurality of dies through a series of interconnected chambers that are selectively sealable from each other, wherein through the series of interconnected chambers, each of the dies (a) is introduced into a controlled gas environment, (b) each of the dies is introduced into a controlled temperature environment, (c) a process-environment-sensitive material is pressurized in each of the dies, and (d) each of the dies is cooled.

In a further embodiment of any of the foregoing embodiments, step (c) includes pressurizing a preform in each of the dies, the preform including the process-environment-sensitive material in a fiber structure.

In a further embodiment of any of the foregoing embodiments, step (c) includes pressurizing a material reservoir containing a melt of the process-environment-sensitive material to transfer the melt from the material reservoir into the die.

In a further embodiment of any of the foregoing embodiments, step (c) includes actuating a plurality of retainer elements to immobilize the die.

In a further embodiment of any of the foregoing embodiments, step (c) includes actuating a ram to pressurize the die.

In a further embodiment of any of the foregoing embodiments, step (b) includes heating the process-environment-sensitive material in the die above a flow temperature of the material.

In a further embodiment of any of the foregoing embodiments, step (a) includes establishing one of a vacuum environment or an inert process gas environment with respect to reactivity with the process-environment-sensitive material.

In a further embodiment of any of the foregoing embodiments, including moving the dies between at least two of the interconnected chambers using a gas cushion.

In a further embodiment of any of the foregoing embodiments, including moving the dies between the interconnected chambers using at least one of a pull or push rod.

A method for processing a process-environment-sensitive material according to an example of the present disclosure includes moving a die serially through a series of interconnected chambers that are selectively sealable from each other, wherein through the series of interconnected chambers: (a) in a first one of the interconnected chambers, introducing the die into a controlled gas environment, (b) in a second one of the interconnected chambers, introducing the die into a controlled temperature environment, (c) in a third one of the interconnected chambers, pressurizing a process-environment-sensitive material in the die, and (d) in a fourth one of the interconnected chambers, cooling the die.

In a further embodiment of any of the foregoing embodiments, the first one of the interconnected chambers is a smallest one of the interconnected chambers.

In a further embodiment of any of the foregoing embodiments, the process-environment-sensitive material is a glass-based material.

An apparatus for processing of a process-environment-sensitive material according to an example of the present disclosure includes a series of interconnected chambers that are selectively sealable from each other. A first one of the interconnected chambers is configured to establish a controlled gas environment therein. A second one of the interconnected chambers is configured to establish a controlled temperature environment therein. A third one of the interconnected chambers is configured to pressurize a process-environment-sensitive material, and a fourth one of the interconnected chambers is configured to cool the process-environment-sensitive material.

In a further embodiment of any of the foregoing embodiments, the first one of the interconnected chambers includes a gas environment control device, the second one of the interconnected chambers includes a heater, the third one of the interconnected chambers includes a pressure actuator, and the fourth one of the interconnected chambers includes a cooling gas control device.

In a further embodiment of any of the foregoing embodiments, further comprising a controller configured to control sealing between the interconnected chambers, control the controlled gas environment, control the controlled temperature environment, control the pressurizing of the process-environment-sensitive material, and control the cooling of the process-environment-sensitive material.

In a further embodiment of any of the foregoing embodiments, the interconnected chambers are non-linearly arranged.

In a further embodiment of any of the foregoing embodiments, further comprising a die configured to be moved serially through the interconnected chambers, the die including a support plate having a plurality of grooves on a bottom surface thereof.

In a further embodiment of any of the foregoing embodiments, at least one of the interconnected chambers includes a perforated support surface and a pressurized gas source connected thereto, the perforated support surface and pressurized gas source operable to provide a gas cushion.

BRIEF DESCRIPTION OF THE DRAWINGS

The various features and advantages of the present disclosure will become apparent to those skilled in the art from the following detailed description. The drawings that accompany the detailed description can be briefly described as follows.

FIG. 8 illustrates the support plate of FIG. 7 in an activated state providing a gas cushion for the die to ride on.

DETAILED DESCRIPTION

Figure 1:
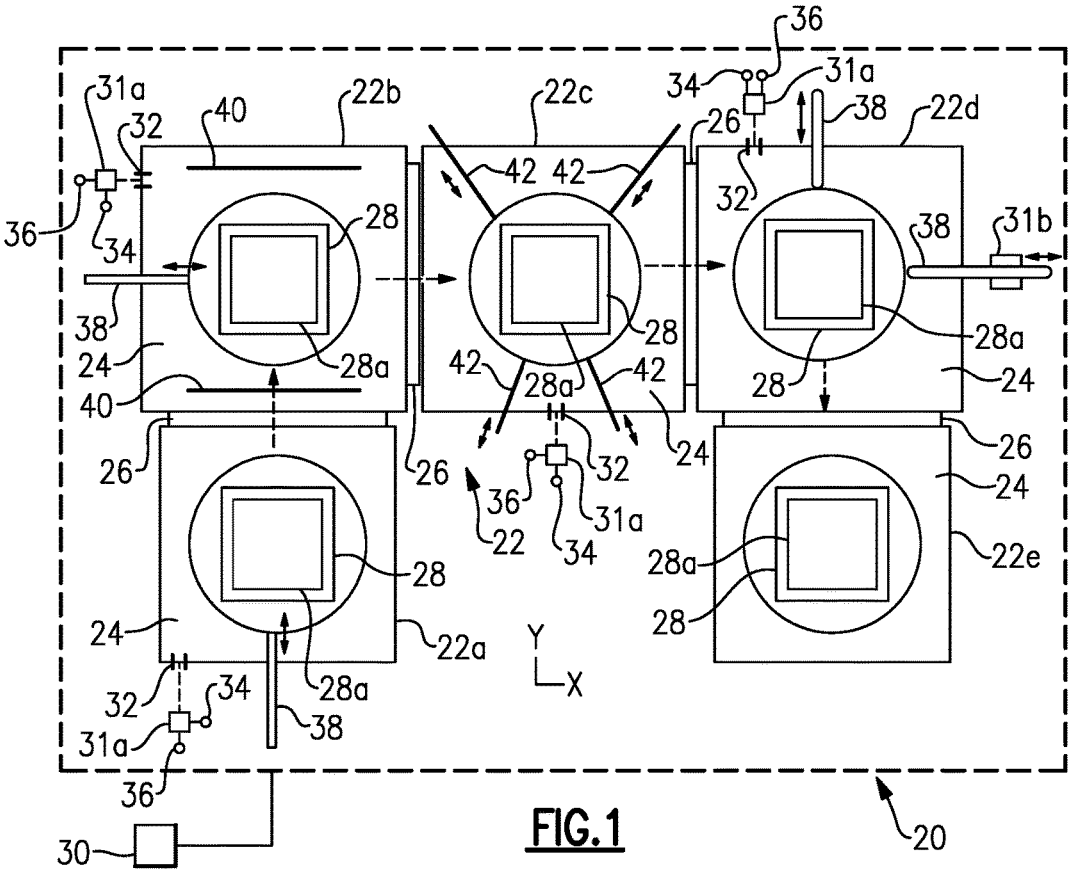
FIG. 1 illustrates an example apparatus for processing a process-environment-sensitive material.

FIG. 1 schematically illustrates an example apparatus 20 that can be used in conjunction with a method for processing, or continuously thermally processing, process-environment-sensitive materials in a relatively rapid manner. A process-environment-sensitive material (hereafter "material") is a material that is formed into a desired article geometry at high temperatures in a controlled environment, such as under vacuum and/or inert cover gas (e.g., argon). Such materials require high temperatures to enable formation and consolidation into the desired geometry and a controlled environment to manage reactions that can undesirably alter the chemistry of the material.

In non-limiting examples, the material can be a ceramic-based material, a glass-based material or a combination of a ceramic/glass-based material. One example includes silicon carbide fiber reinforced ceramic-glass matrix materials. The ceramic-glass matrix can be borosilicate glass or lithium-aluminosilicate glass-ceramic with boron or barium magnesium aluminosilicate glass-ceramic, for example. The fibers can include silicon carbide, alumina, aluminosilicate, or carbon. Fibers can be coated with a fiber-matrix interface layer, such as carbon or boron nitride layers. These and other process-environment-sensitive materials can be rapidly processed into an article using the apparatus 20. Such articles can include, but are not limited to, gas turbine engine articles, such as shrouds, combustor liners of components, turbine support rings, seals and acoustic tiles.

The apparatus 20 includes a series of interconnected chambers 22, represented individually at 22*a*, 22*b*, 22*c*, 22*d* and 22*e*. The chambers 22 are selectively sealable from each other, and each chamber 22 defines an interior 24 in which a particular process step or function is conducted to ultimately form the material into an end-use or near net article. By comparison, conducting multiple steps or function in a single chambers leads to long processing times that can be prohibitively expensive. By using the interconnected chambers 22 and discrete processing steps or functions in each of the chambers 22, the individual chambers 22 can be adapted for more optimally conducting the specific processing step or function, as well as serial processing of the material.

The apparatus 20 includes a plurality of seals 26 between adjacent connected chambers 22. Each seal 26, such as a gate seal, is moveable by an actuator (not shown) between a closed position and an open position. In the open position, the interiors 24 of the adjacent chambers 22 are open to each other, and the in the closed position the interiors of the adjacent chambers 24 are sealed from each other. The chambers 22 can be sized according to the articles that are to be fabricated. The term "interconnected" means that each of the chambers 22 is open or can be opened to at least one other chamber 22 such that a die 28 can be moved between the chambers 22 without removing the die from the chambers 22.

The chambers 22 are arranged serially to process a material in the die 28, or in a series of dies 28, in order, from first chamber 22*a*, to second chamber 22*b*, to third chamber 22*c*, to fourth chamber 22*d* and, optionally, to fifth chamber 22*e*. The chambers 22 each serve a different function in the processing of the material, and each chamber 22 is thus configured for the functionality that it serves. Moreover, if processing a series of dies, the chambers 22 can be operated simultaneously, which reduces the overall processing time, and thus cost.

Generally, the chambers 22 are constructed of materials, such as stainless steel, that are suitable to withstand the processing conditions. Depending on the needs of a particular implementation, the chambers 22 can include cooling features, such as a water cooling system that conveys water through the walls of one or more of chambers 22. Additionally, again depending on the needs of a particular implementation, one or more of the chambers 22 can include one or more ports that permit evacuation of the chambers 22 and/or the introduction of process gas into the chambers 22. The chambers 22 can also include one or more mechanisms for moving the dies 28 through the apparatus 20. Such mechanisms will be described in further detail below.

In this example, chamber 22*a* serves as a loading chamber, chamber 22*b* serves as a preheat chamber, chamber 22*c* serves as a pressurization chamber, chamber 22*d* serves as a cooling chamber, and chamber 22*e* serves as an unloading chamber. The unloading chamber 22*e* can be optional from the standpoint that chamber 22*d* can serve the dual purpose of cooling and unloading, though use of the chamber 22*e* can reduce processing time.

Figure 2:
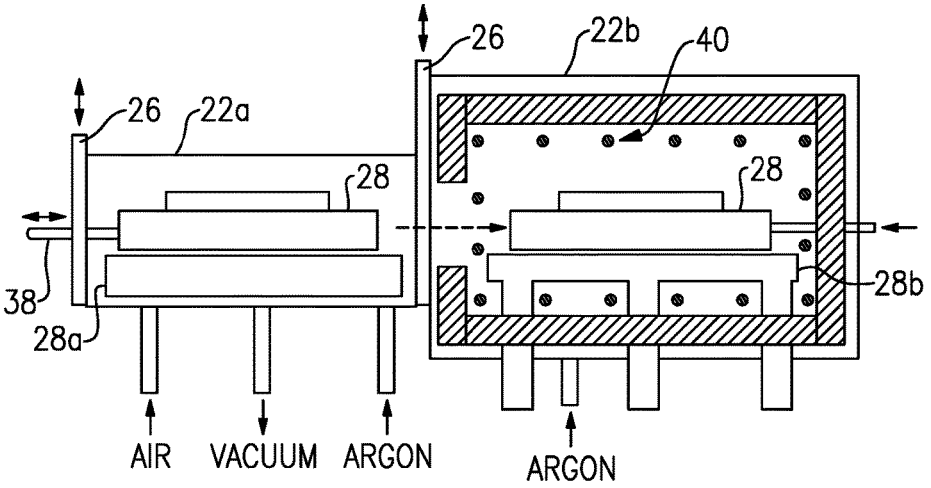
FIG. 2 illustrates a side view of the first two of the chambers of the apparatus of FIG. 1.

The chamber 22*a* serves as a loading chamber for initially receiving the die 28 into the apparatus 20. The chambers 22*a*/22*b* are also shown in schematic side view in FIG. 2, in which the die 28 is supported on, and moveable along, a support plate 28*a*. The die 28 may or may not already contain the material, or a precursor thereof. In one example, a preform of the material within a fiber structure is in the die 28 and will later be pressed into a consolidated form. Alternatively, the preform can be a fiber structure in the die 28, and the material is later infiltrated into the fiber structure to a consolidated form.

Once loaded, the chamber 22*a* is sealed from the surrounding environment and other chambers 22, and a controlled gas environment is established in the interior 24 of the chamber 22*a*. To this and other ends, the apparatus 20 can also include a controller 30 that is in communication with the seals 26, mechanisms for moving the die and, as will be described in further detail below, heating and process gas environment control devices. The controller can be configured to control all operational aspects of the apparatus 20, though some aspects can alternatively be controlled manually. The controller 30 can include hardware, such as a microprocessor and memory, software or both.

In this example, the chamber 22*a* includes at least one port 32 and a gas environment control device 31*a*, such as a valve, by which the environment within the interior 24 can be controlled. For example, the interior 24 of the chamber

22*a* is connected through the port 32 and gas environment control device 31*a* to a vacuum pump 34 and/or pressurized gas source 36. The gas environment control device 31*a*, by command of the controller 30, controls evacuation of, and process gas flow in, the chamber 22*a*. Thus, for a given process having a predefined controlled gas environment, the controller 30 can purge the interior 24 of the chamber 22*a* of air, evacuate the interior 24 to a desired pressure and/or provide an inert process cover gas to a desired pressure. The chamber 22*a* thus provides the controlled gas environment prior the application of heat, which could otherwise cause undesired reactions in the material or degrade the die 28 or other structures of the chamber 22*a*, particularly if the die 28 is graphite. Generally, the interior 24 of the chamber 22*a* is at ambient or near ambient temperature that is below a temperature that causes reaction of the material or that can degrade the die 28 in the presence of air. As shown, chambers 22*b*, 22*c* and 22*d* also include ports 32 and gas environment control devices 31*a*.

The chamber 22*a* can be configured to rapidly achieve the controlled gas environment. For example, the chamber has relatively smooth interior wall surfaces and is free of heating elements and furnace insulation that could otherwise absorb gas a slow purging or evacuation. The chamber 22*a* also can be smaller than one or more of the other chambers 22. In some examples, the chamber 22*a* is the smallest of the chambers 22, to enable rapid management of the controlled gas environment.

In one further example, the chamber 22*a* is operated by the following steps:

1. The entrance door is opened.
2. A graphite die containing a fiber preform/matrix material is inserted into the loading chamber.
3. The entrance door is closed.
4. A vacuum is pumped on the chamber to remove the air.
5. The chamber is backfilled with inert gas, i.e. argon.
6. The exit door is opened and moving rod is used to push the die into the preheat chamber.
7. The exit door is closed.
8. A vacuum is pumped on the chamber to remove the argon.
9. The chamber is backfilled with air.

Upon establishment of the controlled gas environment, the die 28 is then moved into the next chamber, here chamber 22*b*, which serves as a preheating chamber. In this regard, the seal 26 between chambers 22*a* and 22*b* is opened and the movement mechanism used to move the die 28 into the chamber 22*b*, where it is support on, and moveable along, a support plate 28*b*. For example, the movement mechanism is an actuated pull or push rod, represented at 38, which slides the die 28 from chamber 22*a* into chamber 22*b*. As shown, chambers 22*b* and 22*d* also include pull or push rods 38.

In this example, chamber 22*b* serves as a preheating chamber to establish a desired controlled temperature environment for the die 28. To this end, the chamber 22*b* includes a heater 40. The heater 40 can include graphite heating elements, but is not limited to such types. The controlled temperature environment can be a target process temperature for the material to be formed in the die 28. Further, the die 28 can be soaked in the chamber 22*b* at the target process temperature for a desired amount of time to ensure that the die 28 and/or material or precursor thereof, if already in the die 28, reaches the target process temperature. In one example where the die 28 contains the preform of the fiber structure and material, the temperature is a temperature at which the matrix material has mobility to flow among the fibers of the fiber structure. This can be a softening temperature of the material or a temperature at which the material is liquid or semi-solid.

The interior 24 of the chamber 22*b* can have the same controlled gas environment as in the interior 24 of the chamber 22*a*. Thus, upon opening the seal 26 between the chamber 22*a* and 22*b*, there is negligible sacrifice, if any, of the controlled gas environment of either chamber 22*a*/22*b*. Thus, minimal time is needed to re-establish the controlled environments within the chambers 22*a*/22*b* as dies 28 are serially processed.

Figure 3:
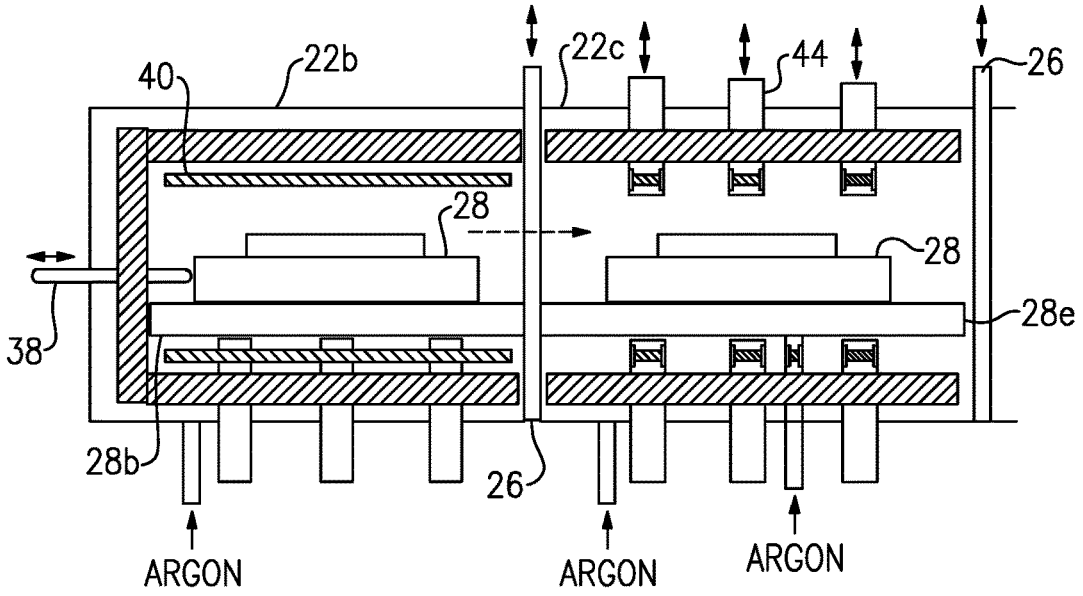
FIG. 3 illustrates a side view of the second and third chambers of the apparatus of FIG. 1.

Once the controlled temperature environment is established in chamber 22*b*, the die 28 is moved into the third chamber 22*c*. In this regard, the seal 26 is opened and the pull or push rod 38 is used to move the die 28 into the chamber 22*c*, where it is supported on, and moveable along, a support plate 28*c*. The chambers 22*b*/22*c* are shown in schematic side view in FIG. 3.

In one example, the chamber 22*b* is a double walled stainless steel construction with continuous water cooling. The heater 40 includes graphite heating elements and porous carbon fiber insulation to retain the heat. The typical temperature range in the chamber 22*b* is 1200° C. to 1600° C., although other temperatures could be used depending on the material being processed. Argon can be purged through the chamber 22*b* to maintain an inert environment in order to prevent oxidation of the carbon materials. An example argon pressure inside the chamber 22*b* is 0.035 kg/cm2 (0.5 psi) and it can be designed not to exceed 0.14 kg/cm2 (2 psi). Optionally, carbon monoxide can be provided around any carbon materials, or other readily degraded materials, to reduce degradation.

In one further example, the chamber 22*b* is operated by the following steps:

1. The preheat chamber is heated to the desired temperature.
2. The die containing the fiber preform/matrix material is moved from the loading chamber into the preheat chamber and the entrance door is closed.
3. The die soaks in the chamber until it reaches the desired temperature.
4. Once the die is at the desired temperature, the exit door is opened and the moving rod is used to push the die into the pressurization consolidation chamber.
5. The exit door is closed.

The chamber 22*c* serves as a pressurization chamber. The interior 24 of the chamber 22*c* can have the same controlled gas environment as in the interior 24 of the chamber 22*b*. Thus, upon opening the seal 26 between the chamber 22*b* and 22*c*, there is negligible sacrifice, if any, of the controlled gas environment of either chamber 22*b*/22*c*. Thus, minimal time is needed to re-establish the controlled environments within the chambers 22*b*/22*c* as dies 28 are serially processed.

The type of pressure used depends upon the type of process that the chamber 22*c* is configured to carry out. For example, the pressurization can be hot pressing or, alternatively, transfer pressing. In this example, the chamber 22*c* is configured for hot pressing and includes retainer elements 42 and a pressure actuator 44. The retainer elements 42 can be rods that can be actuated to engage the die 28 on several sides to immobilize the die 28. The retainer elements 42 keep the various parts of the die 28 compressed in the circumferential direction while at the same time being able to adjust to differential thermal growth as the die 28 is heated and cooled.

The pressure actuator 44 can be a ram that is actuatable to press the die 28. The ram can be actuated by hydraulic, pneumatic or other type of actuation, to press and hold the die at a controlled pressure for a desired amount of time until the die 28 cools to a predetermined temperature to ensure that the material is sufficiently rigid to avoid spring-back. In the case where the preform of a fiber structure and the matrix material is already in the die 28, the applied pressure and temperature achieved in the chamber 22*b* causes the material to move to open, void areas in the preform between the fibers, thus consolidating the preform.

Figure 4:
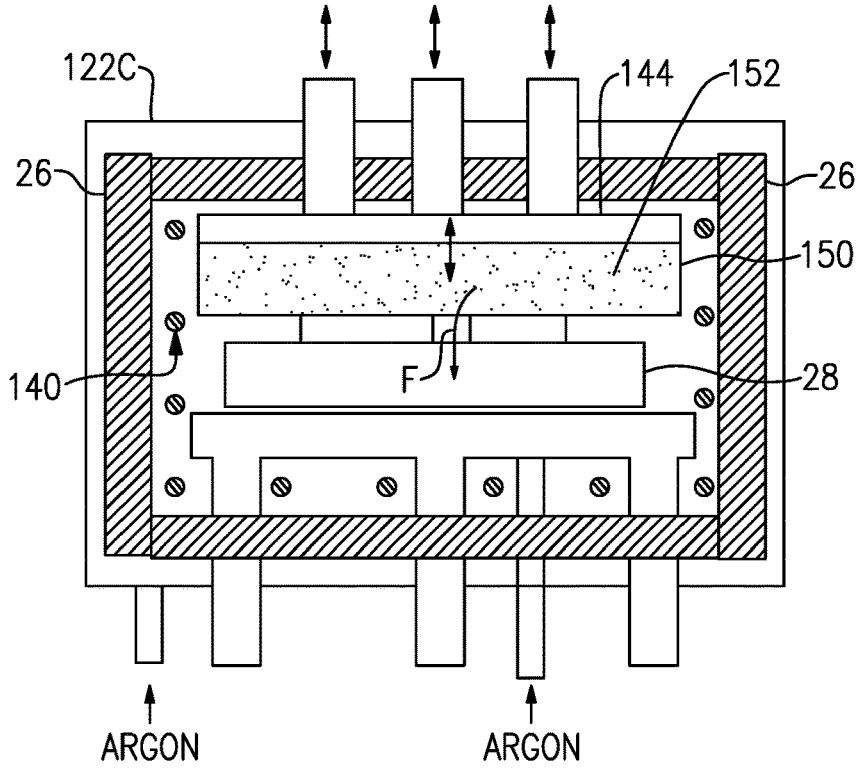
FIG. 4 illustrates a side view of an alternative third chamber of the apparatus of FIG. 1.

FIG. 4 shows an alternative chamber 122*c* that can be used in place of the chamber 22*c* in the apparatus 20. The chamber 122*a* is configured for transfer pressing. In this example, the chamber 122*c* includes a material reservoir 150 containing a melt 152 of the material. Here, a ram 144 is actuated to pressurize the melt 152, causing the melt to flow, as represented at F, into the die 28. The die can contain a fiber structure such that the melt infiltrates the fibers to form a consolidated article. Optionally, the chamber 122*c*, or chamber 22*c*, can include a heater 140, to control the temperature within the chambers 22*c*/122*c*.

The chamber 22*c*/122*c* can be a double walled stainless steel construction with continuous water cooling. Optionally, the chamber 22*c*/122*c* can include a heater having graphite heating elements and porous carbon fiber insulation to retain the heat. The typical temperature range in the chamber 22*c* or 122*c* is 1200° C. to 1600° C., although other temperatures could be used. The specific temperature will depend on the material being processed. Argon can be purged through the chamber 22*c*/122*c* to maintain an inert atmosphere in order to prevent oxidation of any carbon materials. A typical argon pressure inside the chamber 22*c*/122*c* can be 0.035 kg/cm2 (0.5 psi) and it can be designed not to exceed 0.14 kg/cm2 (2 psi). Optionally, carbon monoxide can be provided around any carbon materials, or other degradation-sensitive materials, to reduce degradation.

In one further example, the chamber 22*c* is operated by the following steps:

1. If not already at temperature, the chamber is heated to the desired temperature.
2. The graphite die containing the fiber preform/matrix material is moved from the preheat chamber from the pressurization consolidation chamber and the entrance door is closed.
3. The "die retaining rods" are actuated to circumferentially retain the die.
4. The die soaks in the chamber until it reaches the desired temperature, if not already at temperature.
5. The ram applies pressure to consolidate the fiber and glass into a dense composite.
6. The heater, if used, is shut off.
7. The pressure is maintained on the composite until the composite temperature is below 500° C. or other predetermined temperature to ensure that the glass or other material is sufficiently rigid to prevent fiber spring-back, which could result in composite delamination.
8. Once the die reaches the predetermined temperature and the pressure is removed, the "die retaining rods" are withdrawn.
9. The exit door is opened and the die is moved into the cooling chamber.
10. The exit door is closed.

In one further example, the chamber 122*c* is operated by the following steps:

1. If not already at temperature, the chamber is heated to the desired temperature.
2. The graphite die containing the fiber preform is moved from the preheat chamber from the pressurization consolidation chamber and the entrance door is closed.
3. The "die retaining rods" are actuated to circumferentially retain the die.
4. The graphite die soaks in the chamber until it reaches the desired temperature.
5. The ram's downward motion is initiated with control of the ram travel rate so that glass is forced to flow from a glass reservoir into a fiber preform at a controlled rate.
6. When the pressure on the ram reaches the desired pressure (e.g., 1,000 ksi), the ram switches from ram travel control to pressure control.
7. The heat is shut off.
8. The pressure is maintained on the composite until the composite temperature is below 500° C. or other predefined temperature to ensure that the glass is sufficiently rigid to prevent fiber spring-back, which could result in composite delamination.
9. Once the die reaches 500° C. or other predetermined temperature, the pressure is removed and the "die retaining rods" are withdrawn.
10. The exit door is opened and the die is moved into the cooling chamber.
11. The exit door is closed.

Figure 5:
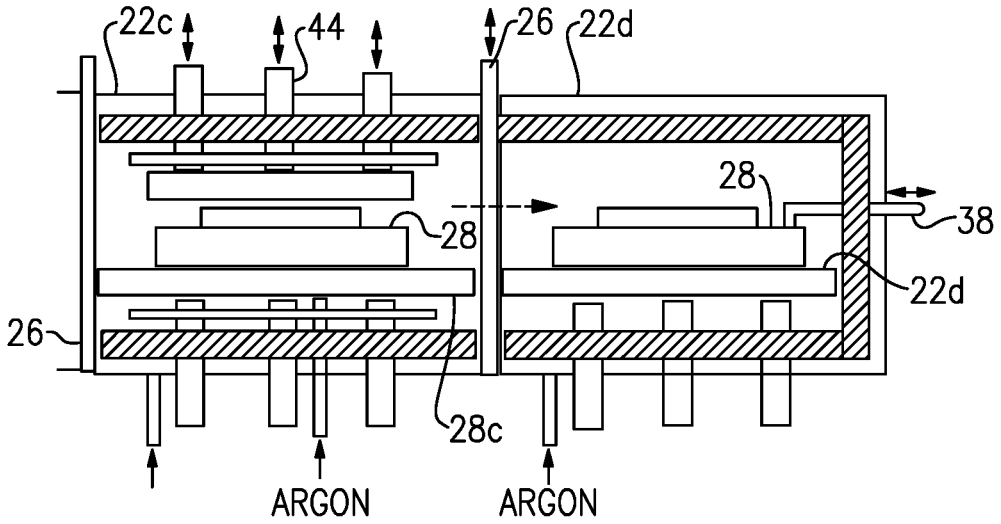
FIG. 5 illustrates a side view of the third and fourth chambers of the apparatus of FIG. 1.

After processing in the chamber 22*c* or 122*c*, the die 28 is moved into the fourth chamber 22*d*. In this regard, the seal 26 is opened and the pull or push rod 38 is used to move the die 28 into the chamber 22*d*, where it is supported on, and moveable along, a support plate 28*d*. The chambers 22*c*/22*d* are shown in schematic side view in FIG. 5. As shown in FIG. 5, the dies 28 are maintained at a constant height within the chambers 22*c* and 22*d*.

The chamber 22*d* serves as a cooling chamber to cool the die 28 and material, now formed into the article, to a desired temperature. In this regard, the temperature in the interior 24 of the chamber 22*d* is controlled to provide a desired cooling rate and/or to cool the die 28 and/or article to a desired temperature. Relatively cool argon or other inert process cover gas can be conveyed through the interior 24 to carry heat away from the die 28. Once a suitable temperature of the die 28 is reached, the die 28 can be unloaded from the apparatus 20 or moved to the fifth chamber 22*e* for unloading.

The chamber 22*d* can be a double walled stainless steel construction with continuous water cooling. Optionally, the chamber 22*d* can be lined with porous carbon fiber insulation to protect the walls. Argon can be purged through the chamber 22*d* to maintain an inert atmosphere in order to prevent oxidation of any carbon materials. A typical argon pressure inside the chamber 22*d* can be 0.035 kg/cm2 (0.5 psi) and it can be designed not to exceed 0.14 kg/cm2 (2 psi).

In one further example, the chamber 22*d* is operated by the following steps:

1. The graphite die containing the fiber preform/matrix material is moved from the pressurization chamber into the cooling chamber.
2. The entrance door is closed.
3. The graphite die is cooled.
4. Once the die is at a desired temperature (e.g., below 200° C.), open the exit door and use the die moving rod to push the die into the unloading chamber.
5. The exit door is closed.

Figure 6:
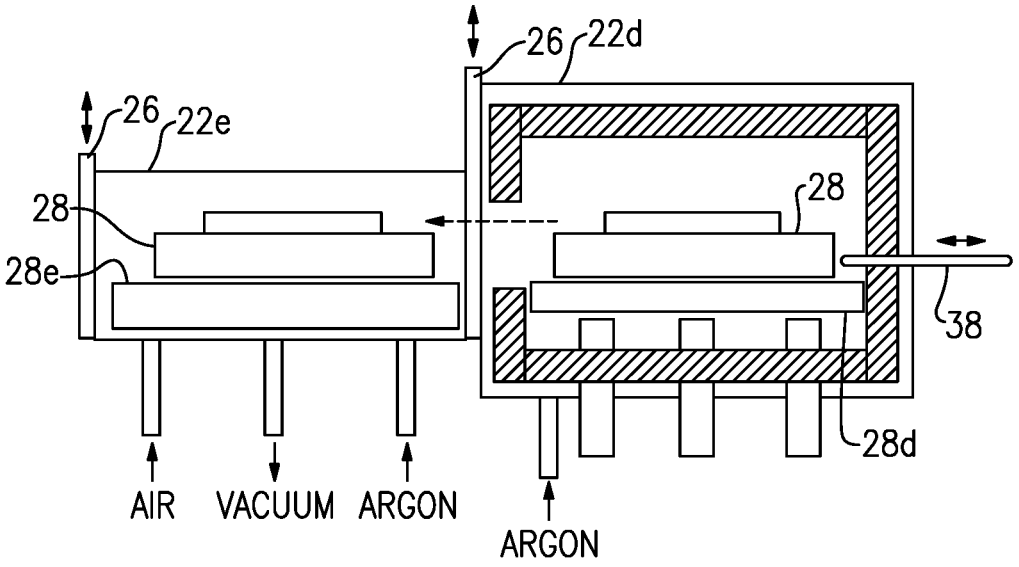
FIG. 6 illustrates a side view of the fourth and fifth chambers of the apparatus of FIG. 1.

If used, the chamber 22*e* serves as an unloading chamber. In this regard, the seal 26 is opened and the pull or push rod 38 is used to move the die 28 into the chamber 22*e*, where it is supported on, and moveable along, a support plate 28*e*. The chambers 22*c*/22*d* are shown in schematic side view in FIG. 6. Similar to the chamber 22*a*, the chamber 22*e* includes at least one port 32 and a gas environment control device 31*a* by which the environment within the interior 24 can be controlled. The interior 24 of the chamber 22*e* can have the same controlled gas environment as in the interior 24 of the chamber 22*d*. Thus, upon opening the seal 26 between the chamber 22*d* and 22*e*, there is negligible sacrifice, if any, of the controlled gas environment of either chamber 22*d*/22*e*. Thus, minimal time is needed to re-establish the controlled environments within the chambers 22*d*/22*e* as dies 28 are serially processed.

In one example, the chamber 22*e* is a double walled stainless steel construction with continuous water cooling. The chamber 22*e* can be configured to rapidly achieve a controlled gas environment. For example, the chamber has relatively smooth interior wall surfaces, with rubber o-rings at the exit and entrance doors, and is free of heating elements and furnace insulation that could otherwise absorb gas a slow purging or evacuation. The chamber 22*e* also can be smaller than one or more of the other chambers 22. In some examples, the chamber 22*e* is the smallest of the chambers 22, to enable rapid management of the controlled gas environment and/or temperature controlled environment.

In one further example, the chamber 22*e* is operated by the following steps:

1. Evacuate the unloading chamber and backfill with argon.
2. Open the entrance door and use the die moving rod to push the die from the cooling chamber into the unloading chamber.
3. Close the entrance door.
4. Pump a vacuum on the chamber to remove the argon.
5. Backfill with air.
6. Open the exit door and remove the graphite die containing the consolidated article.

As shown in FIG. 1, the chambers 22 are non-linearly arranged. Here, chambers 22*b*, 22*c* and 22*d* are arranged linearly, and chambers 22*a* and 22*e* are arranged laterally of chambers 22*b*, 22*c* and 22*d*. Alternatively, chamber 22*a*, chamber 22*b* or both could be arranged to the other lateral side of the chambers 22*b*, 22*c* and 22*d*. The non-linear arrangement enables use of the push or pull rods 38, or other movement mechanisms. By comparison, if the chamber 22*a* were arranged to the left of chamber 22*b* in FIG. 1, the chamber 22*a* would interfere with the push or pull rod 38 of chamber 22*b*. By arranging the chambers 22*a* and 22*e* lateral to the chambers 22*b*, 22*c* and 22*d*, the chambers 22*a* and 22*e* do not interfere with the positioning of the push or pull rods 38.

Figure 8:
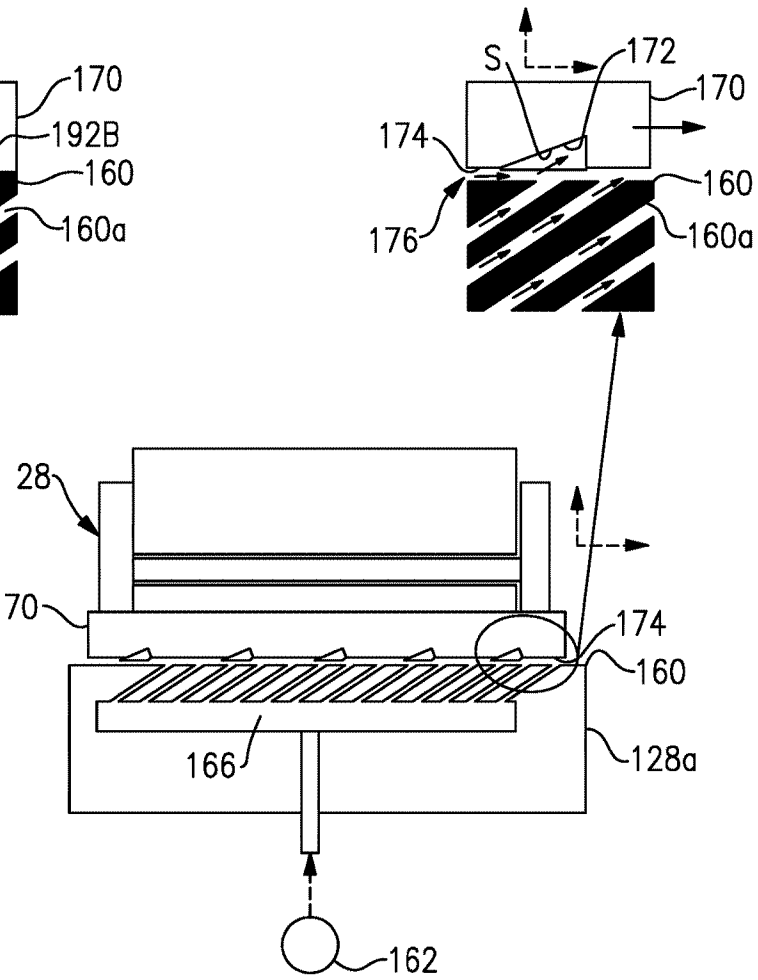
Figure 7:
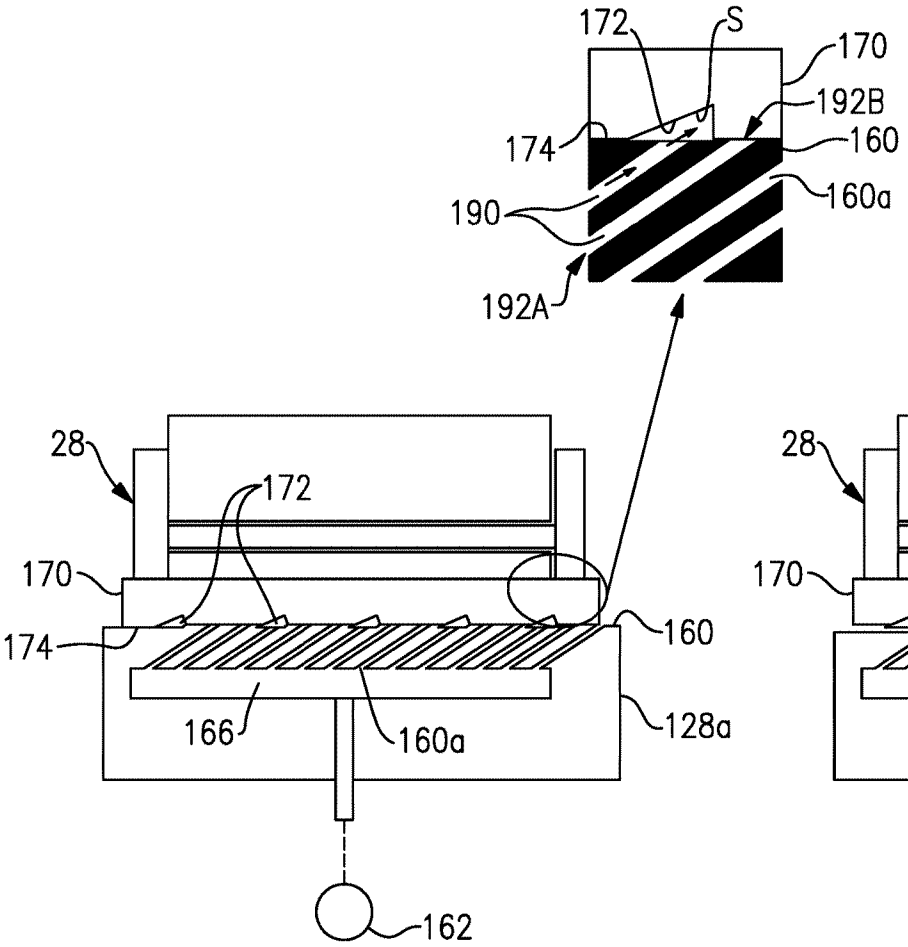
FIG. 7 illustrates a support plate that can be used in any or all of the chambers of FIG. 1 to move, or facilitate movement, of a die.

FIG. 7 and FIG. 8 show an alternative support plate 128*a* that can be used in any or all of the chambers 22 to move, or facilitate movement, of the die 28. The support plate 128*a* includes a perforated support surface 160 through which a pressurized gas, such as argon, from a pressurized gas source 162 can be provided. In this example, the pressurized gas is provided into a manifold 166 in the support plate 128*a*. Perforations 160*a* in the perforated support surface 160 open to the manifold 166 and to the top surface of the perforated support surface 160 and provide gas channels 190 therebetween. Each gas channel 90 has an inlet 192A that receives pressurized gas from the manifold 166, and an outlet 192B that delivers pressurized gas to a moveable support plate 170. Upon supply of the pressurized gas to the manifold 166, the gas jets from the perforations 160*a*. The jetted gas provides a gas cushion 176 for the moveable support plate 170, and die 28, to ride on. The gas can also be jetted during a pressurization hold step in chamber 22*c*/122*c*, to facilitate cooling of the die 28. Once the pressure is removed, the die 28 then floats on the gas cushion 176.

In this example, the die 28 is supported on a moveable support plate 170 that has a plurality of grooves 172 on a bottom surface 174 thereof. The grooves 172 open to the perforations 160*a* and serve to cooperate with the gas cushion 176 to facilitate movement. For example, the perforations 160*a* are sloped relative to the plane of the perforated support surface 160 such that gas jets out from the perforations 160*a* at a sloped angle. The sloped angle urges the support plate 170, and die 28, to move on the gas cushion 176 in the direction of the slope. The gas pressure can be adjusted according to the mass of the moveable support plate 170 and die 28 so that the moveable support plate 170 and die 28 move substantially in the horizontal component of the sloped angle, while maintaining a constant or approximately constant vertical distance between the moveable support plate 170 and the perforated support surface 160.

The grooves 172 can have a geometry that compliments the sloped angle to enhance movement on the gas cushion 176. For example, the grooves 172 are slanted along a direction equivalent to or approximately equivalent to the sloped angle. In the illustrated example, the grooves 172 have a triangular cross-section, with a side, S, that is slanted in a direction equivalent to or approximately equivalent to the sloped angle.

The gas cushion 176 and jetting of the gas can be used as a sole movement mechanism to move the die 28 in the apparatus 20. Alternatively, the gas cushion 176 and jetting of the gas can be used to facilitate movements in combination with one or more of the pull or push rods 38 or other movement mechanisms. For example, the gas cushion 176 and jetting reduce friction and thus reduce the amount of force needed to move the die 28.

The apparatus 20 enables the continuous and rapid processing of process-environment-sensitive material. For example, a plurality of the dies 28 can be serially moved through the chambers 22 such that the dies 28 are simultaneously processed. That is, up to five dies 28 can be processed at once. The configuration of the apparatus 20 can also be adapted to various processing techniques, such as hot pressing and glass transfer molding. Moreover, the rapid processing times can improve properties of the final article by reducing the time that fibers, or other structures that can be degraded at high temperatures, of the article are exposed to high processing temperatures.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method for continuous thermal processing of process-environment-sensitive material into an article, the method comprising:

serially moving a plurality of dies through a series of interconnected chambers that are selectively sealable from each other with seals that can be opened and closed, wherein through the series of interconnected chambers:

(a) each of the dies is introduced into a controlled gas environment, (b) each of the dies is introduced into a controlled temperature environment, (c) a process-environment-sensitive material is pressurized in each of the dies, causing the process-environment-sensitive material to be formed into an article having a geometry of the die, and (d) each of the dies is cooled, and the article is unloaded from the cooled die;

wherein said serially moving comprises:

supporting the plurality of dies on a plurality of respective moveable support plates; and delivering pressurized gas to the plurality of moveable support plates through a plurality of gas channels, the pressurized gas providing a gas cushion that moves the plurality of moveable support plates and the respective dies they support between at least two of the interconnected chambers;

wherein each moveable support plate has a plurality of grooves on a bottom surface, the grooves having a triangular cross-section having a side that is sloped at an angle approximately the same as that of the gas channels, the gas channels delivering the pressurized gas from a gas source to the grooves.

2. The method as recited in claim 1, wherein said step (c) includes pressurizing a preform in each of the dies, the preform including the process-environment-sensitive material in a fiber structure.

3. The method as recited in claim 1, wherein said step (c) includes pressurizing a material reservoir containing a melt of the process-environment-sensitive material to transfer the melt from the material reservoir into the die.

4. The method as recited in claim 1, wherein said step (c) includes actuating a plurality of retainer elements to immobilize the die.

5. The method as recited in claim 4, wherein said step (c) includes actuating a ram to pressurize the die.

6. The method as recited in claim 1, wherein said step (b) includes heating the process-environment-sensitive material in the die above a flow temperature of the material.

7. The method as recited in claim 1, wherein said step (a) includes establishing one of a vacuum environment or an inert process gas environment with respect to reactivity with the process-environment-sensitive material.

8. The method as recited in claim 1, including moving the dies between the interconnected chambers using at least one of a pull or push rod.

9. A method for processing a process-environment-sensitive material into an article, the method comprising:

moving a die serially through a series of interconnected chambers that are selectively sealable from each other with seals that can be opened and closed, wherein through the series of interconnected chambers:

(a) in a first one of the interconnected chambers, introducing the die into a controlled gas environment, (b) in a second one of the interconnected chambers, introducing the die into a controlled temperature environment, (c) in a third one of the interconnected chambers, pressurizing a process-environment-sensitive material in the die, causing the process-environment-sensitive material to be formed into an article having a geometry of the die, (d) in a fourth one of the interconnected chambers, cooling the die, and (e) in the fourth or a fifth one of the interconnected chambers, unloading the article from the cooled die;

wherein said moving the die comprises:

supporting the die on a moveable support plate; and delivering pressurized gas to the moveable support plate through a plurality of gas channels, the pressurized gas providing a gas cushion that moves the moveable support plate and the die it supports between at least two of the interconnected chambers;

wherein the moveable support plate has a plurality of grooves on a bottom surface, the grooves having a triangular cross-section having a side that is sloped at an angle approximately the same as that of the gas channels, the gas channels delivering the pressurized gas from a gas source to the grooves.

10. The method as recited in claim 9, wherein the first one of the interconnected chambers is a smallest one of the interconnected chambers.

11. The method as recited in claim 9, wherein the process-environment-sensitive material is a glass-based material.

12. The method as recited in claim 1, wherein the plurality of gas channels are sloped with respect to a direction of movement of the moveable support plates.

13. The method as recited in claim 1, wherein an inert gas is purged through the chamber within which the process-environment-sensitive material is pressurized to maintain an inert atmosphere.

14. The method as recited in claim 9, wherein an inert gas is purged through the third chamber to maintain an inert atmosphere.

15. The method as recited in claim 1, wherein a first one of the interconnected chambers is used in said step (b) and a second one of the interconnected chambers is used in said step (c), the method comprising maintaining the dies at a constant height within the first and second chambers of said steps (b) and (c).

16. The method as recited in claim 9, comprising maintaining the die at a constant height within the respective chambers of said steps (b) and (c).

17. The method as recited in claim 3, wherein said pressurizing a material reservoir containing a melt of the process-environment-sensitive material to transfer the melt from the material reservoir into the die includes actuating a ram to pressurize the melt.

18. The method as recited in claim 9, wherein said step (c) includes actuating a ram to pressurize a melt of the process-environment-sensitive material contained in a material reservoir to transfer the melt from the material reservoir into the die, causing the process-environment-sensitive material to be formed into an article having a geometry of the die.

* * * * *